US007874539B2

(12) United States Patent
Wright et al.

(10) Patent No.: US 7,874,539 B2
(45) Date of Patent: Jan. 25, 2011

(54) INTEGRAL NAIL BAR HANGER FOR RECESSED LUMINAIRE

(75) Inventors: Craig D. Wright, Moore, SC (US); Ronald C. Newbold, Roebuck, SC (US); Christopher C. Primous, Greer, SC (US); Clyde W. George, Boiling Springs, SC (US)

(73) Assignee: Hubbell Incorporated, Shelton, CT (US)

( * ) Notice: Subject to any disclaimer, the term of this patent is extended or adjusted under 35 U.S.C. 154(b) by 633 days.

(21) Appl. No.: 11/528,693

(22) Filed: Sep. 28, 2006

(65) Prior Publication Data

US 2007/0075206 A1 Apr. 5, 2007

Related U.S. Application Data

(60) Provisional application No. 60/722,004, filed on Sep. 30, 2005.

(51) Int. Cl.
*F16M 13/00* (2006.01)

(52) U.S. Cl. ..... 248/547; 248/323; 248/343; 248/906

(58) Field of Classification Search ..... 248/547, 248/200.1, 323, 298.1, 343, 906
See application file for complete search history.

(56) References Cited

U.S. PATENT DOCUMENTS 3,104,087 A * 9/1963 Budnick et al. ..... 248/343
3,214,126 A 10/1965 Roos
4,041,657 A * 8/1977 Schuplin ..... 52/39
4,511,113 A 4/1985 Druffel et al.
4,803,603 A 2/1989 Carson
4,972,339 A 11/1990 Gabrius
5,045,985 A 9/1991 Russo et al.
5,057,979 A 10/1991 Carson et al.
5,222,800 A 6/1993 Chan et al.
5,374,812 A 12/1994 Chan et al.
5,386,959 A * 2/1995 Laughlin et al. ..... 248/205.1
5,505,419 A 4/1996 Gabrius
5,588,737 A * 12/1996 Kusmer ..... 362/148
5,690,423 A 11/1997 Hentz et al.
5,934,631 A 8/1999 Becker et al.
5,938,157 A * 8/1999 Reiker ..... 248/200.1
5,957,573 A 9/1999 Wedekind et al.
5,957,574 A 9/1999 Hentz et al.
6,004,011 A 12/1999 Sieczkowski
6,076,788 A * 6/2000 Akiyama ..... 248/200.1
6,082,878 A 7/2000 Doubek et al.

(Continued)

*Primary Examiner*—Terrell Mckinnon
*Assistant Examiner*—Bradley H Duckworth
(74) *Attorney, Agent, or Firm*—Garrett V. Davis; Mark S. Bicks; Alfred N. Goodman

(57) ABSTRACT

A bar hanger assembly is provided for supporting a recessed electrical device in a ceiling support. The bar hanger includes first and second telescoping support arms that are slidably connected together for adjusting the length of the bar hanger. The support arms having an elongated body with first and second ends and a mounting plate coupled to the first end. The mounting plate is oriented substantially perpendicular to the plane of the body. An attachment member is coupled to a bottom edge of the mounting plate for attaching to the bottom edge of a ceiling joist. The attachment member includes a detent extending from one side thereof. The attachment member can be bent from a first position perpendicular to the mounting plate to a second position parallel to the mounting plate for attaching to a T-bar support.

30 Claims, 11 Drawing Sheets

U.S. PATENT DOCUMENTS 6,230,464 B1 5/2001 Wrame
6,286,265 B1 9/2001 Rinderer
6,341,466 B1 * 1/2002 Kehoe et al. ..... 52/712
6,491,270 B1 * 12/2002 Pfaller ..... 248/200.1
6,967,284 B1 * 11/2005 Gretz ..... 174/58
2005/0230589 A1 10/2005 Wronski

* cited by examiner

INTEGRAL NAIL BAR HANGER FOR RECESSED LUMINAIRE

CROSS-REFERENCE TO RELATED APPLICATION

This application claims the benefit of provisional application Ser. No. 60/722,004, filed Sep. 30, 2005, which is hereby incorporated by reference in its entirety.

FIELD OF THE INVENTION

The present invention is directed to a bar hanger for supporting a recessed luminaire and lighting fixture to ceiling joists and to a T-bar support of a suspended ceiling. The invention is particularly directed to a bar hanger that can be adapted for mounting to either a ceiling joist or to a T-bar support of a suspended ceiling.

BACKGROUND OF THE INVENTION

Recessed luminaires and lighting fixtures for installation in wood construction typically include bar hangers that are coupled to the luminaire and including mounting ends for attachment to adjacent ceiling joists. Bar hangers commonly include a barbed or hooked nailer that is integrally formed from the bar hanger material blank. The bar hanger head is placed against the joist and a hammer is used to drive the nailer into the wood to fix the bar hanger to the joist. Once the nailer is driven into the joists, the wood and the nailer are permanently deformed and are not easily removed. This limits the ability to adjust the position of the bar hanger and luminaire once attached to the ceiling joist. Generally, a secondary fastener such as a nail or screw is added by the installer to ensure that the bar hanger is securely mounted to the ceiling joist.

Various support devices have been developed to support luminaires and other lighting fixtures in ceilings. The support devices can be a conventional bar hanger for attaching to ceiling joists or for attachment to a T-bar support rail for suspended ceilings. The bar hangers generally include a two-piece assembly having a pair of rails that are slidably connected together. The rails can be extended or retracted to fit between adjacent ceiling joists. One example of a bar hanger support for a recessed lighting fixture is disclosed in U.S. Pat. No. 5,505,419 to Gabrius. In this device, the end portion of the bar hanger is provided with a bridge supporting a nail for attaching the bar hanger to the ceiling joist. A similar device is also disclosed in U.S. Pat. No. 5,222,800 to Chan et al.

Other lighting fixtures and lighting supports are able to attach to ceiling joists or to a T-bar of a suspended ceiling. For example, U.S. Pat. No. 5,957,574 to Hentz et al. discloses a lighting assembly having adjustable nailing plates at each end. A recess is formed in the edge of the frame to mount to a T-bar support. A similar device is also disclosed in U.S. Pat. No. 6,004,011 to Sieczkowski.

While the above-noted bar hanger supports are generally suitable for their intended use, there is a continuing need for improved support members.

SUMMARY OF THE INVENTION

The present invention is directed to a bar hanger assembly for supporting a recessed luminaire and lighting fixture. The invention is particularly directed to a bar hanger assembly that can be mounted to a ceiling joist or to a T-bar support of a suspended ceiling.

The bar hanger of the invention is suitable for use in mounting electrical devices such as a lighting fixture to be recessed in a ceiling. The bar hanger includes sliding arms for adjusting the length of the bar hanger assembly to fit between adjacent joists. The ends of the arm include a mounting plate for attachment to the side surfaces of the ceiling joist. An attachment tab extends from the mounting plate along the bottom edge which is positioned along the bottom edge of the ceiling joist to position the bar hanger a predetermined distance from the bottom edge of the ceiling joist.

Another aspect of the invention is to provide a bar hanger assembly that can be modified for use with either ceiling joists or a T-bar support of a suspended ceiling. In one embodiment, the bar hanger includes a detent or hook-like member for attaching the bar hanger to the T-bar support.

A further aspect of the invention is to provide a bar hanger assembly having a tab that can be attached to a bottom surface of a ceiling joist where the tab can be bent to a position for attaching to a T-bar support.

A further aspect of the invention is to provide a bar hanger assembly having a tab that can be attached to a ceiling joist and bent to a different position for coupling with a T-bar support.

The various aspects of the invention are basically attained by providing a bar hanger for supporting a recessed electrical device on a ceiling support. The bar hanger has first and second telescoping support arms slidably connected together. Each support arm comprises an elongated support body having a first end and a second end. A mounting plate is coupled to the first end of the body and extends substantially perpendicular to a plane of the support body. The mounting plate has at least one aperture for receiving a fastener. An attachment member is coupled to a bottom edge of the mounting plate along a fold line. The attachment member has a substantially planar first side and an opposite second side, and a detent extending from the second side. The attachment member is bendable from a first position where the attachment plate extends substantially perpendicular to the mounting plate for contacting a bottom surface of a ceiling joist to a second position substantially parallel to the mounting plate for attaching to a T-bar support.

The aspects of the invention are further attained by providing a bar hanger for supporting a recessed electrical device to a ceiling support. The bar hanger has first and second telescoping support arms coupled together for sliding movement in a longitudinal direction. Each support arm comprises a support body having a longitudinal dimension with a first end, a second end, a top edge and a bottom edge. The bottom edge has a recess at the first end with a dimension to receive a T-bar support. A mounting plate is coupled to the first end of the support body and extends substantially perpendicular to a plane of the support body. The mounting plate has at least one aperture for receiving a fastener for attaching the mounting plate to a ceiling joist. A first attachment member and a second attachment member is coupled to a bottom edge of the mounting plate and extends in a direction substantially perpendicular to the mounting plate for attaching to a bottom side of a ceiling joist. The first attachment member has a detent extending in a direction from a bottom side where the first attachment member is bendable from a first position perpendicular to the mounting plate to a second position substantially parallel to the mounting plate for contacting a bottom surface of the T-bar support.

The aspects of the invention are also attained by providing a bar hanger for supporting a recessed electrical device. The bar hanger has first and second telescoping support arms coupled together for sliding movement in a longitudinal direction. Each support arm comprises a support body having a longitudinal dimension with a first end and a second end, a top edge and bottom edge. A mounting plate is coupled to the first end of the support body and extends in a direction substantially perpendicular to the longitudinal dimension of the support body. An attachment member extends from a bottom edge of the mounting plate for contacting a bottom edge of a ceiling joist. The mounting plate has an aperture for receiving a fastener and a raised bridge integrally formed with the mounting plate and has a center portion spaced from the mounting plate to define an opening between the center portion and the mounting plate. A fastener extends through and couples to the bridge. The bridge has a longitudinal dimension extending at an acute angle with respect to a plane of the attachment member to enable a tool to be inserted into the opening and apply leverage against the ceiling joist.

These and other aspects of the invention will become apparent from the following detailed description and the annexed drawings which disclose various embodiments of the invention.

BRIEF DESCRIPTION OF THE DRAWINGS

The following is a brief description of the drawings in which.

DETAILED DESCRIPTION OF THE INVENTION

The present invention is directed to a bar hanger for supporting a recessed electrical device, such as a luminaire and lighting fixture, to the ceiling joists or the T-bar of a suspended ceiling. The invention is particularly directed to a bar hanger that can be mounted to either a conventional ceiling joist or to a T-bar of a suspended ceiling.

Figure 1:
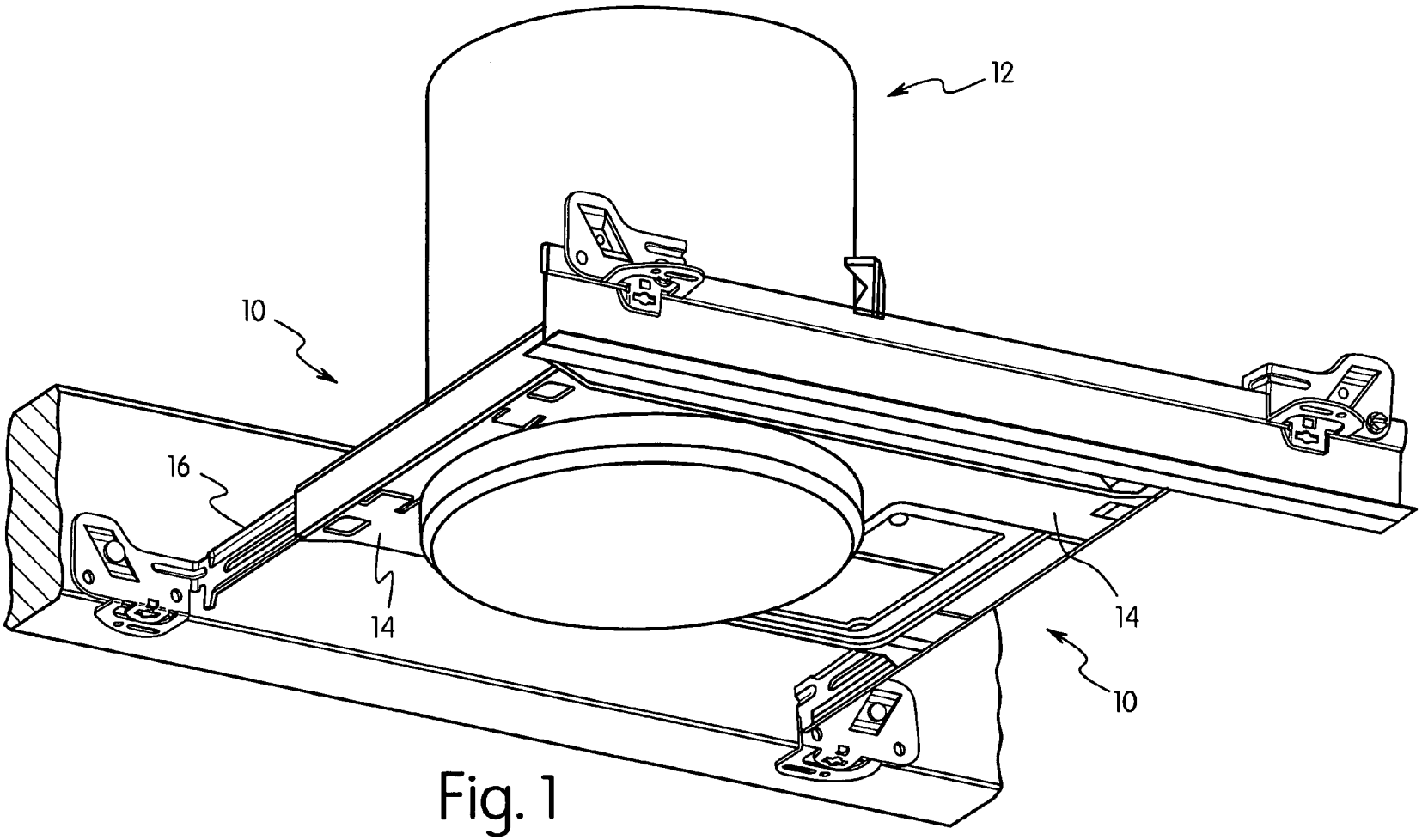
FIG. 1 is a perspective view of the bar hanger in a first embodiment of the invention showing the bar hanger attached to a ceiling joist and a T-bar support.
Figure 2:
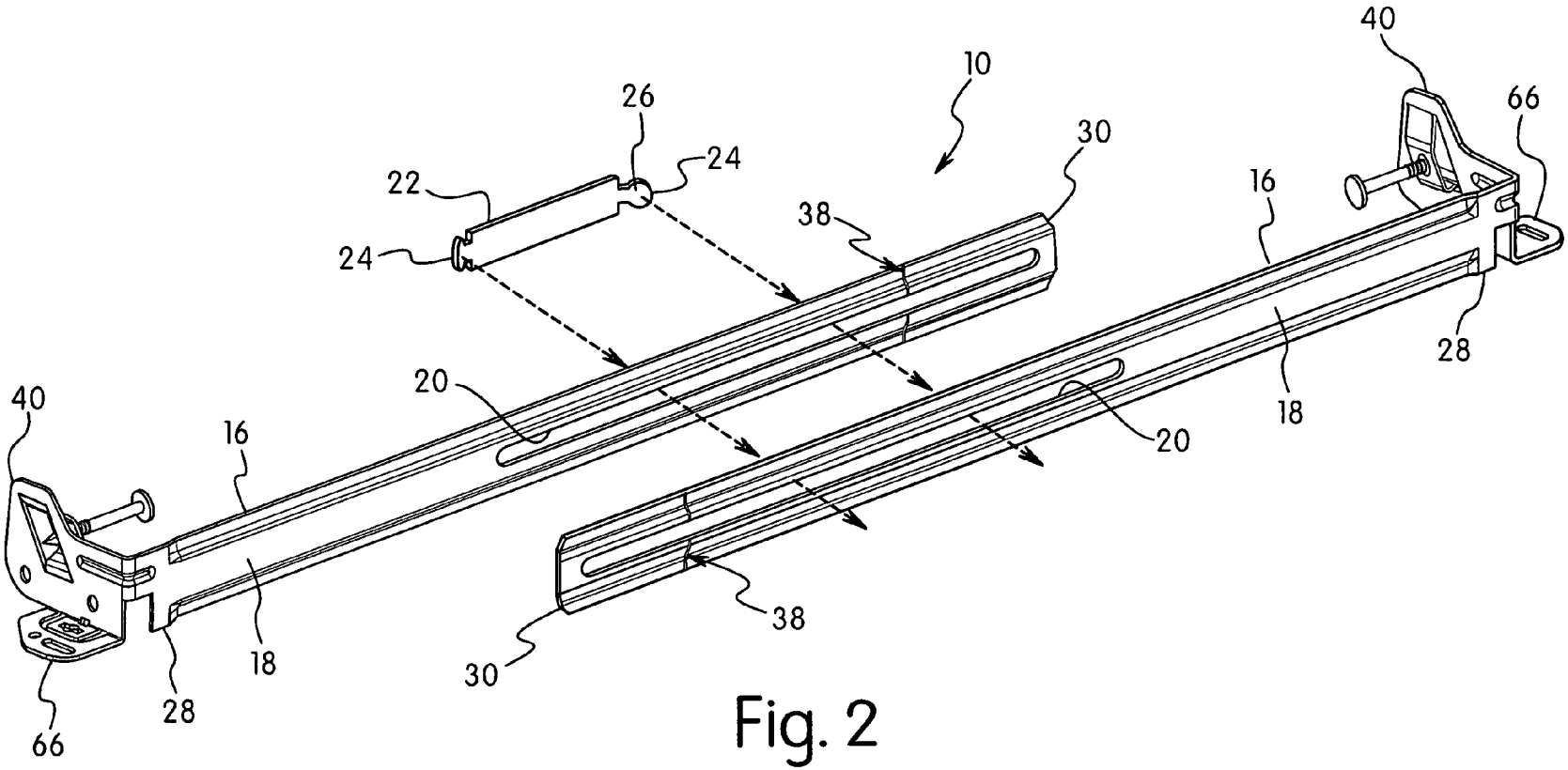
FIG. 2 is an exploded perspective view of the bar hanger of FIG. 1.

Referring to the drawings, the invention in one embodiment is directed to a bar hanger 10 for supporting an electrical device. In the embodiments illustrated, the electrical device is a recessed luminaire and lighting fixture 12 that is attached to a support member 14. Support member 14 is attached to bar hanger 10 for positioning lighting fixture 12 in a recessed position with respect to the ceiling. As shown in FIG. 1, support member 14 is attached to a pair of bar hangers 10 with each bar hanger 10 extending between ceiling joists.

In the embodiment of FIGS. 1-11, bar hanger 10 includes support arms 16 that are coupled together in a sliding manner so that the length of bar hanger 10 can be adjusted to the appropriate width between ceiling joists.

Support arms 16 have a longitudinal dimension and have a longitudinal channel 18 to allow each support arm 16 to slide with respect to each other. In this embodiment the channel 18 includes an elongated slot 20 for receiving a coupling member 22 for the coupling the support arms together while allowing longitudinal sliding movement. In other embodiments the support arm can be constructed in a telescoping arrangement where one arm forms a channel so that one support arm slides within the channel. Coupling member 22 include a pair of tabs 24 having enlarged heads 26 that are inserted through slots 22 for coupling support arms 16 together.

Figures 3, 4:
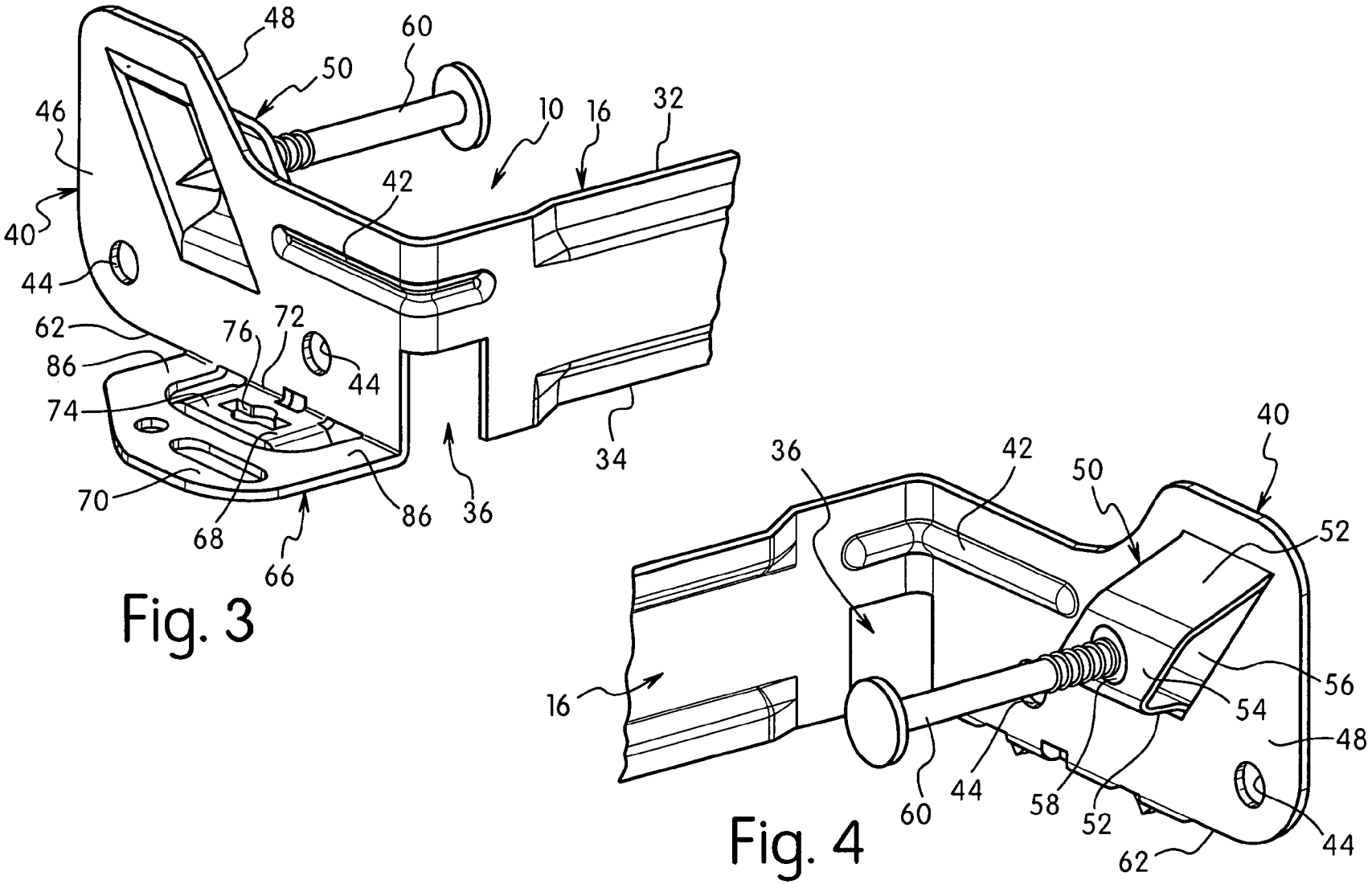
FIG. 3 is a perspective view of the mounting end of the bar hanger.
FIG. 4 is a perspective view of an inside face of the mounting plate of the bar hanger.

Support arms 16 have a first end 28 and a second end 30 with a top edge 32 and a bottom edge 34. As shown in FIG. 3, bottom edge 34 has a notch formed at first end 28. As discussed hereinafter, notch 36 has a dimension to receive a T-bar support commonly used in suspended ceilings so that the bar hanger can be attached to and suspended by a T-bar ceiling support.

In one embodiment, support arm 16 includes a plurality of spaced-apart score lines 38 with apertures. Score lines 38 are preferably spaced-apart a distance to reduce the longitudinal length of bar hanger 10 when needed to fit between narrow ceiling joists.

Referring to FIGS. 3-6, a mounting plate 40 is coupled to first end 28 of support arm 16 for attaching bar hanger 10 to a ceiling joist or other vertical support. Preferably, mounting plate 40 is integrally formed with support arm 16 and is bent substantially 90° with respect to the plane of support arm 16. In the embodiment shown, an embossed area 42 is formed that extends from first end 28 of support arm 16 and along mounting plate 40 to strengthen the corner portion of the connection between mounting plate 40 and support arm 16. The embossed area 42 projects away from the nailing surface of mounting plate 40 so as not to interfere with the attachment member of the bar hanger to a joist.

Figure 5:
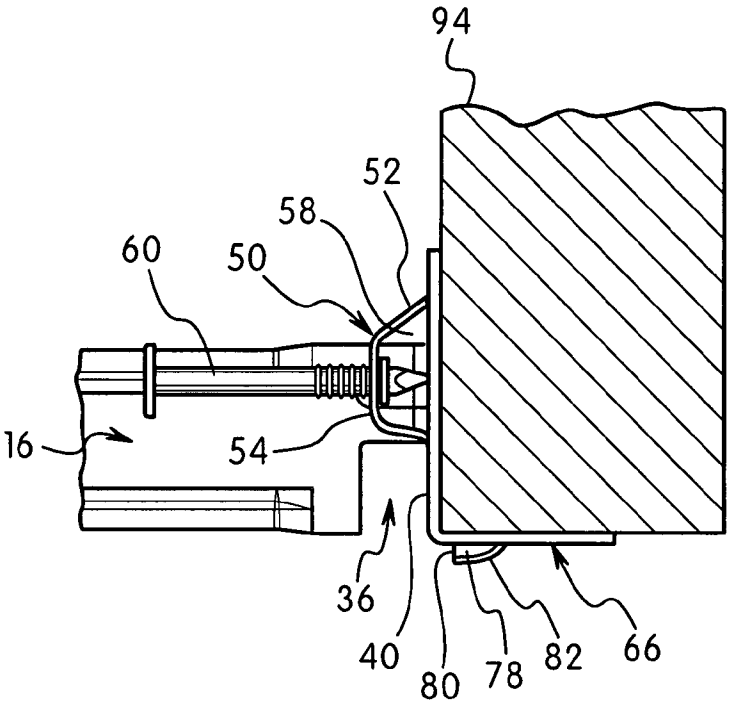
FIG. 5 is a side view of the mounting plate of the bar hanger showing the nailing bridge.

Mounting plate 40 has a dimension to attach to a ceiling joist and includes one or more holes 44 for receiving a fastener (not shown) for permanently attaching mounting plate 40 and support arm 16 to the ceiling joist. Mounting plate 40 has an outer face 46 for contacting the ceiling joist and an opposite inner face 48. As shown in FIG. 4, an embossed cut-out forms a bridge 50 that extends from inner face 48. In the embodiment illustrated, bridge 50 includes a pair of legs 52 extending from mounting plate 40 to a center portion 54. In one embodiment center portion 54 and legs 52 of bridge 50 form a curved arch shape. Preferably, bridge 50 is integrally formed with mounting plate 40 and is cut and punched from the material of mounting plate 40. Center portion 54 is spaced from the plane of inner face 48 of mounting plate 40 to form an opening 56. Raised center portion 54 includes a centrally located aperture 58 for receiving a fastener 60. Preferably, aperture 58 has an internal dimension to capture fastener 60 so that fastener 60 remains coupled to bridge 50 during assembly. As shown in FIG. 5, fastener 60 is initially inserted into aperture 58 a distance to be captured by aperture 58 without extending beyond mounting plate 40.

Figure 6:
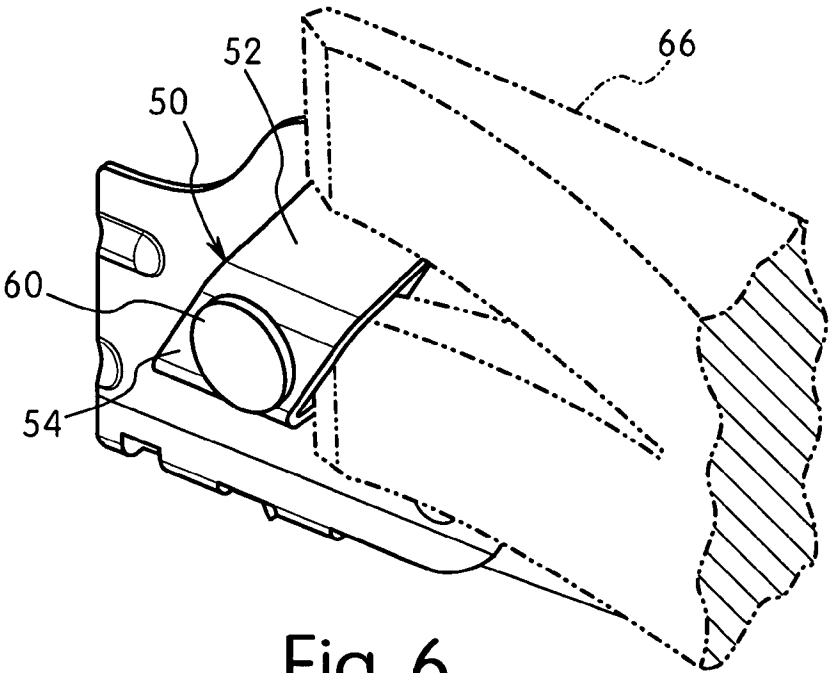
FIG. 6 is an elevational view showing a tool inserted into the bridge for removing a fastener.

In preferred embodiments, bridge 50 is formed at a diagonal with respect to the longitudinal dimension of mounting plate 40 and at an acute angle with respect to a bottom edge 62 of mounting plate 40. Opening 56 has a dimension and is oriented in a position so that a tool, such as a claw hammer 64 as shown in FIG. 6, can be inserted into opening 56 to apply leverage against the ceiling joist or other support surface to allow removal of mounting plate 40 from a ceiling joist. Preferably the bridge 50 is oriented so that the worker can easily insert the claw of a hammer or other tool into the opening and apply sufficient leverage to remove the bar hanger. In one embodiment the bridge is oriented at about a 45 degree angle with respect to the bottom edge of mounting plate 40.

An attachment member 66 is coupled to mounting 40 as shown in FIG. 3. Attachment member 66 has a substantially planar configuration and extends in a direction perpendicular from outer face 46 of mounting plate 40 along bottom edge 62. Attachment member 66 preferably has a dimension to contact a bottom face of a ceiling joist to position bar hanger 10 and the associated lighting fixture 12 in an appropriate position with respect to the ceiling and ceiling joist. In this manner attachment member 66 serves as an alignment tab.

In the embodiment of FIGS. 1-11, attachment member 66 includes a first attachment tab 68 and a second attachment tab 70. First attachment tab 68 has a substantially rectangular configuration and is attached to mounting plate 40 along bottom edge 62 by a fold line 72. First attachment tab 68 includes a circular cutout 74 with an aperture 76. The ends of center portion 74 are formed with detents or barbs in the form of coupling tabs 78 that are folded in a generally downward direction at an incline with respect to the plane of center portion 74 with respect to the orientation shown in FIG. 3. Coupling tabs 78 have a straight edge 80 and an arcuate edge 72 extending from straight edge 80 to an outer side edge 84 of center portion 74.

Second attachment tab 70 has a generally U-shaped configuration surrounding first attachment tab 68. Second attachment tab 70 includes a pair of legs 86 coupled to bottom edge 62 of mounting plate 40 and a main body portion 88 extending between legs 66. Body portion 88 in the embodiment illustrated has a circular hole 90 for receiving a fastener and an elongated hole 92. Elongated hole 92 is provided to allow adjustment and positioning of hanger bar 10 with respect to a ceiling joist.

In use, bar hanger 10 is attached to lighting fixture 12 and the resulting assembly is positioned between ceiling joists or ceiling supports. Bar hanger 10 is adaptable for mounting to a standard ceiling joist or to a T-bar support for suspended ceilings. As shown in FIG. 1, bar hanger 10 is attached to a standard ceiling joist 94 by positioning bar hanger 10 so that attachment member 66 abuts a bottom edge of ceiling joist 94 and mounting plate 40 abuts a side surface of ceiling joist 94. Attachment member 66 aligns and positions support arm 16 with respect to a bottom edge of ceiling joist 94 so that lighting fixture 12 is recessed a correct distance with respect to the ceiling. Typically, lighting fixture 12 is recessed a distance with respect to the ceiling material that is attached to the ceiling joist 94.

Bar hanger 10 can be mounted between a pair of spaced-apart ceiling joists 94. Bar hanger 10 is positioned in the desired location and fastener 60 is hammered to penetrate ceiling joist 94 to hold bar hanger 10 in the desired position. In the event further adjustment is needed, a claw hammer or other prying tool can be inserted into the opening under bridge 50 so that fastener 60 can be removed to reposition bar hanger 10. As shown in FIG. 6, the prying tool can be inserted under bridge 50 in a direction substantially parallel to the bottom edge of ceiling joist 94 so that leverage can be applied against the ceiling joist to remove fastener 60.

Figure 8:
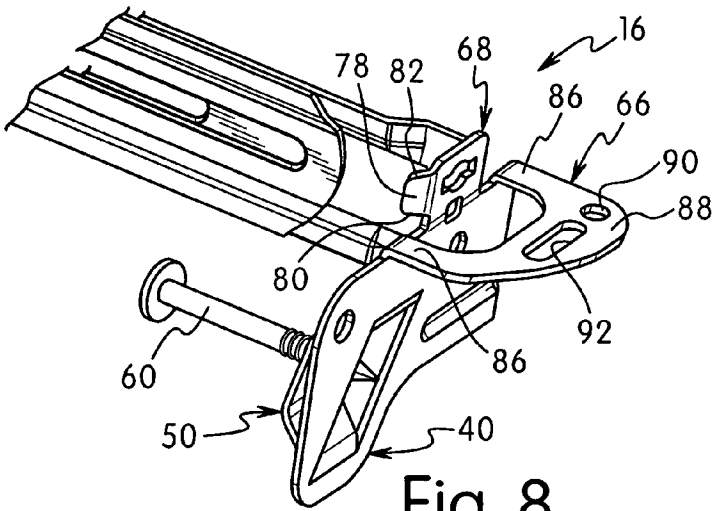
FIG. 8 is a perspective view showing the coupling tab bent to a second position.
Figure 9:
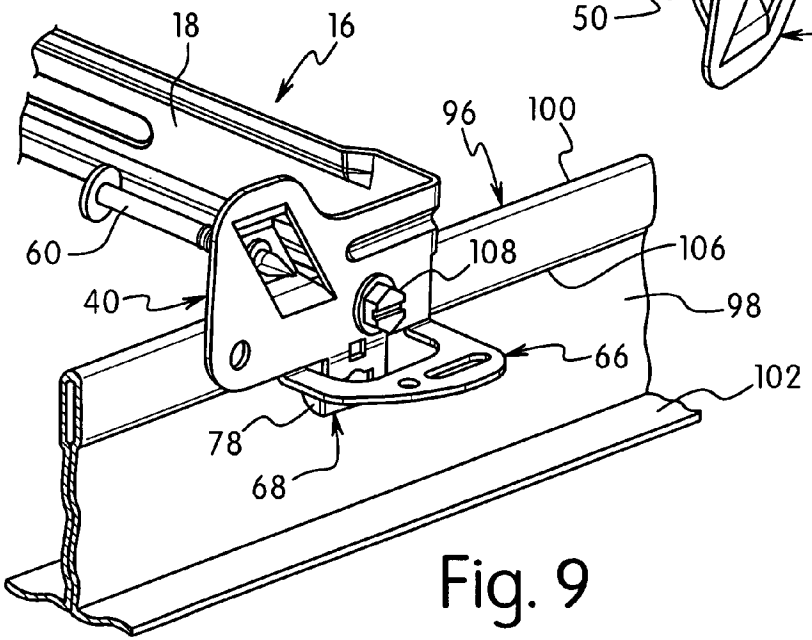
FIG. 9 is a perspective view showing the mounting end of the bar hanger coupled to a T-bar support.
Figure 7:
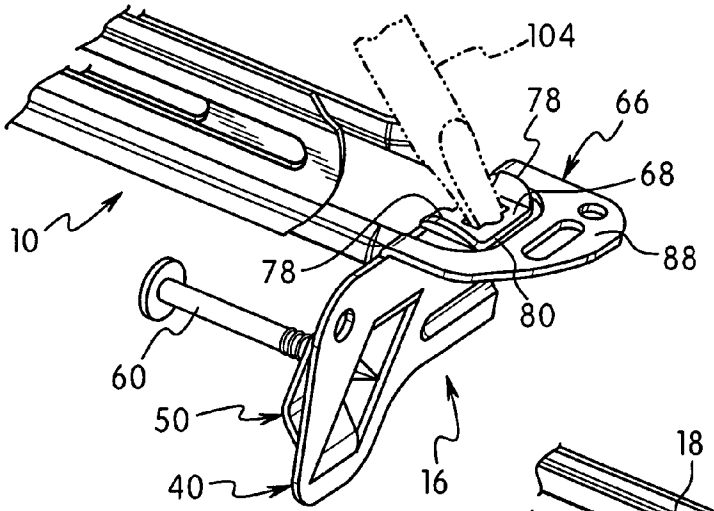
FIG. 7 is a perspective view showing a tool inserted into an opening of the coupling tab for bending the coupling tab.
Figure 10:
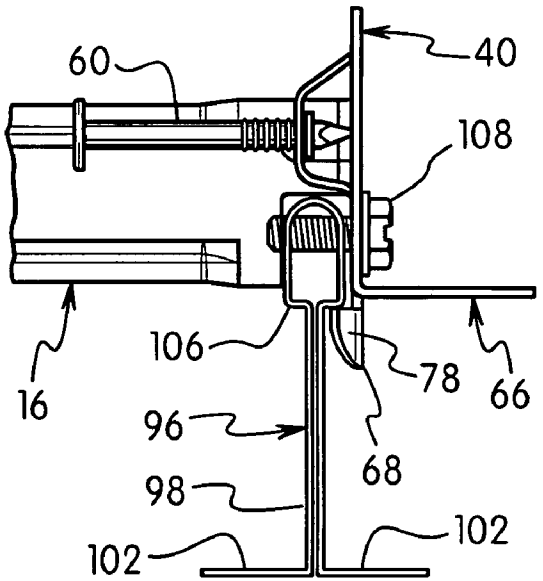
FIG. 10 is an elevational side view showing the bar hanger mounted on a T-bar support.

Alternatively, bar hanger can mounted to ceiling joists by positioning the bar hanger and attaching by fasteners extending through elongated slot 92. This provides some adjustment of the bar hanger to a desired position. The fastener captured by the bridge can then be hammered into the joist. Additional fasteners are generally added to secure the bar hanger in place Bar hanger 10 is also adaptable to mount directly to a T-bar ceiling support 96 as shown in FIGS. 1, 9 and 10. In the embodiment illustrated, T-bar support 96 is a standard ceiling support for suspended ceiling tiles and includes a body portion 98 with a reinforcing top edge 100 and outwardly extending flanges 102 along a bottom edge for supporting ceiling tiles. The top edge 100 typically has an enlarged portion defining a longitudinal channel. In the embodiment shown, the top edge 100 of the T-bar supports have hollow channels with inclined upper surfaces and a flat bottom edge extending perpendicular to the plane of the body 98 to define a lip 106. Bar hanger 10 is adaptable for mounting directly to T-bar support 96 by bending first attachment tab 68 from the position perpendicular to the plane of mounting plate 40 to a position substantially parallel to mounting plate 40 as shown in FIG. 8. Aperture 76 in first attachment tab 68 has a dimension to receive a tool such as a screw driver 104 to bend attachment tab 68 to the position shown in FIG. 8. A cutout 77 is provided along the bend line between attachment plate 68 and mounting plate 40 to assist in bending. In the position shown in FIG. 8, first attachment tab 68 is oriented so that coupling tabs 78 extend inwardly with respect to inner face 48 of mounting plate 40.

Bar hanger 10 is mounted to T-bar support by positioning top edge 100 of T-bar support 96 within notch 36 in support arm 16. As shown in FIG. 10, coupling tabs 78 are able to engage the bottom edge of lip 106 along the top edge of T-bar support 96. In this manner, bar hanger 10 essentially snaps onto T-bar support 96. Typically, a fastener 108 such as a threaded screw, is inserted through hole 44 in mounting plate 40 for permanently securing bar hanger 10 to T-bar support 98.

Figure 11:
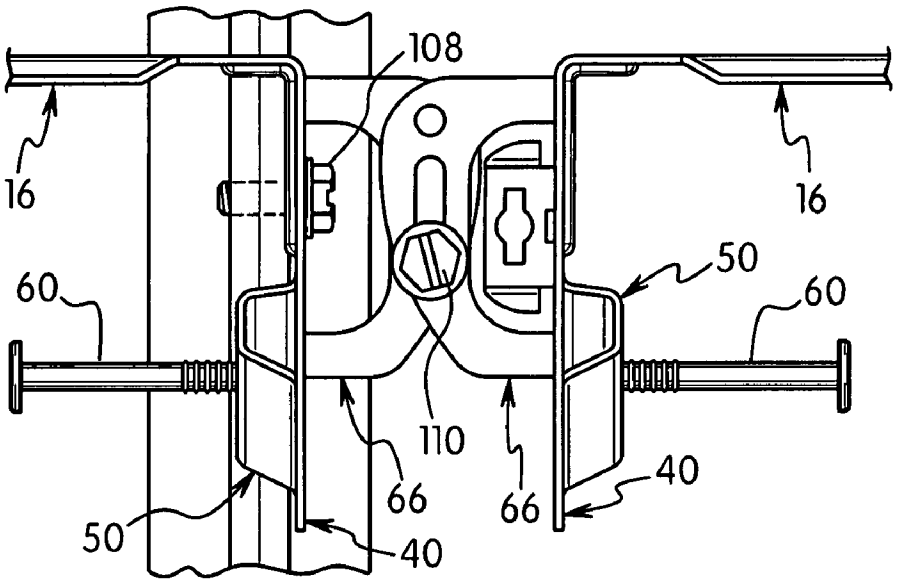
FIG. 11 is a top view showing two adjacent bar hangers coupled together.

As shown in FIGS. 10 and 11, second attachment plate 70 can remain attached to mounting plate 40 in its original position perpendicular to the plane of mounting plate 40 and extending outwardly from T-bar support 96. Second attachment tab 70 has a dimension and structure for coupling with an attachment member of an adjacent bar hanger when it is desirable to mount two lighting fixtures adjacent to each other. As shown in FIG. 11, two bar hangers and the respective attachment members can be superimposed and coupled together by a screw 110 or other fastener. In this fashion one end of the bar hanger can be attached to and supported by the adjacent bar hanger.

A second embodiment of the invention is shown in FIGS. 12-15. The bar hanger 112 is similar to the previous embodiment and includes support arms 114 coupled together for sliding movement, a mounting plate 116 coupled to a first end of the respective support arm 114 and an attachment member 118.

Figure 14:
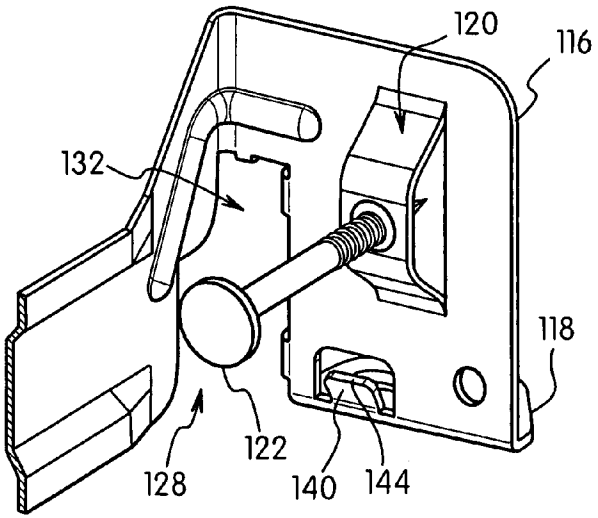
FIG. 14 is a perspective view of the inner face of the mounting plate having a removable tab separated from the mounting plate.
Figure 13:
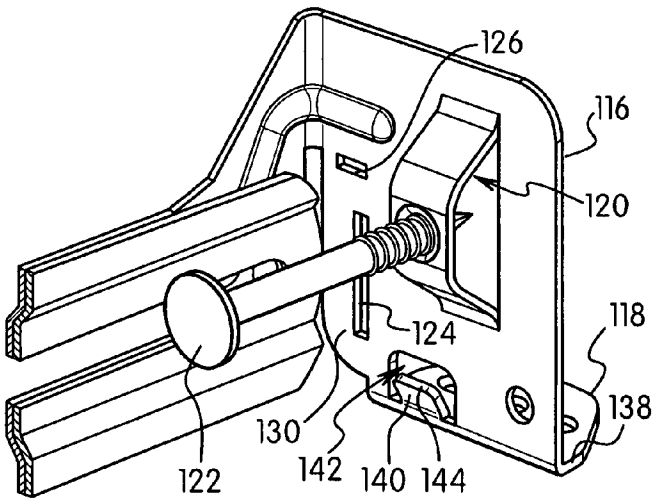
FIG. 13 is a perspective view of an inner face of the mounting plate of the bar hanger of FIG. 12.

Attachment member 118 has a substantially planar configuration extending perpendicular to the plane of the respective support arm 114. A bridge 120 is formed to capture a fastener 122 for attaching bar hanger to a ceiling joist as in the previous embodiment. In the previous embodiment, the length of the bar hanger 112 can be shortened only by the length of the respective support arms since the ends of the support arms contact the mounting plate. A removable tab is provided which can be removed in the field to allow the support arm or channel to pass beyond the mounting plate. In the embodiment shown in FIG. 13, mounting plate 116 includes a first vertical slot 124 and a second horizontal slot 126 adjacent the support arm 114 and notch 128 for receiving the T-bar support. Slots 124 and 126 define break lines so that a section of mounting plate 116 can be removed as shown in FIG. 14. The section 130 of mounting plate 116 can be removed by inserting a tool into the slots 124 and 126 to pry or break the section 130 from mounting plate 116.

Figure 15:
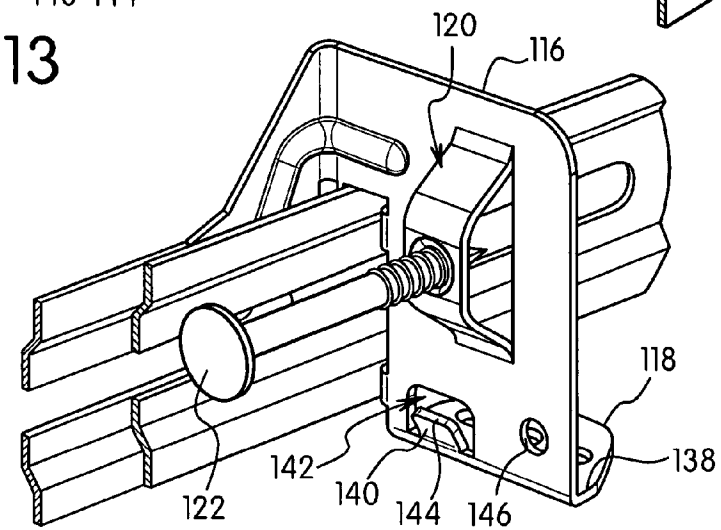
FIG. 15 is a perspective view showing the body of a bar hanger extending through an opening formed in the mounting plate of the bar hanger.

The section 130 can be bent perpendicular to the plane of mounting plate 116 or completely removed to define an opening 122 as shown in FIG. 14. In this manner, the length of bar hanger 112 and the distance between the mounting plates 116 can be reduced by allowing the ends of the support arms to extend through opening 132 past the respective mounting plate 116 as shown in FIG. 15. Bar hanger 112 can be attached to a ceiling joist as in the previous embodiment. Support arms 114 can be cut or broken along frangible lines so that the ends of support arms 114 do not extend past mounting plate 116. In this manner, mounting plate 116 can be attached to a ceiling joist as in the previous embodiment.

Figure 12:
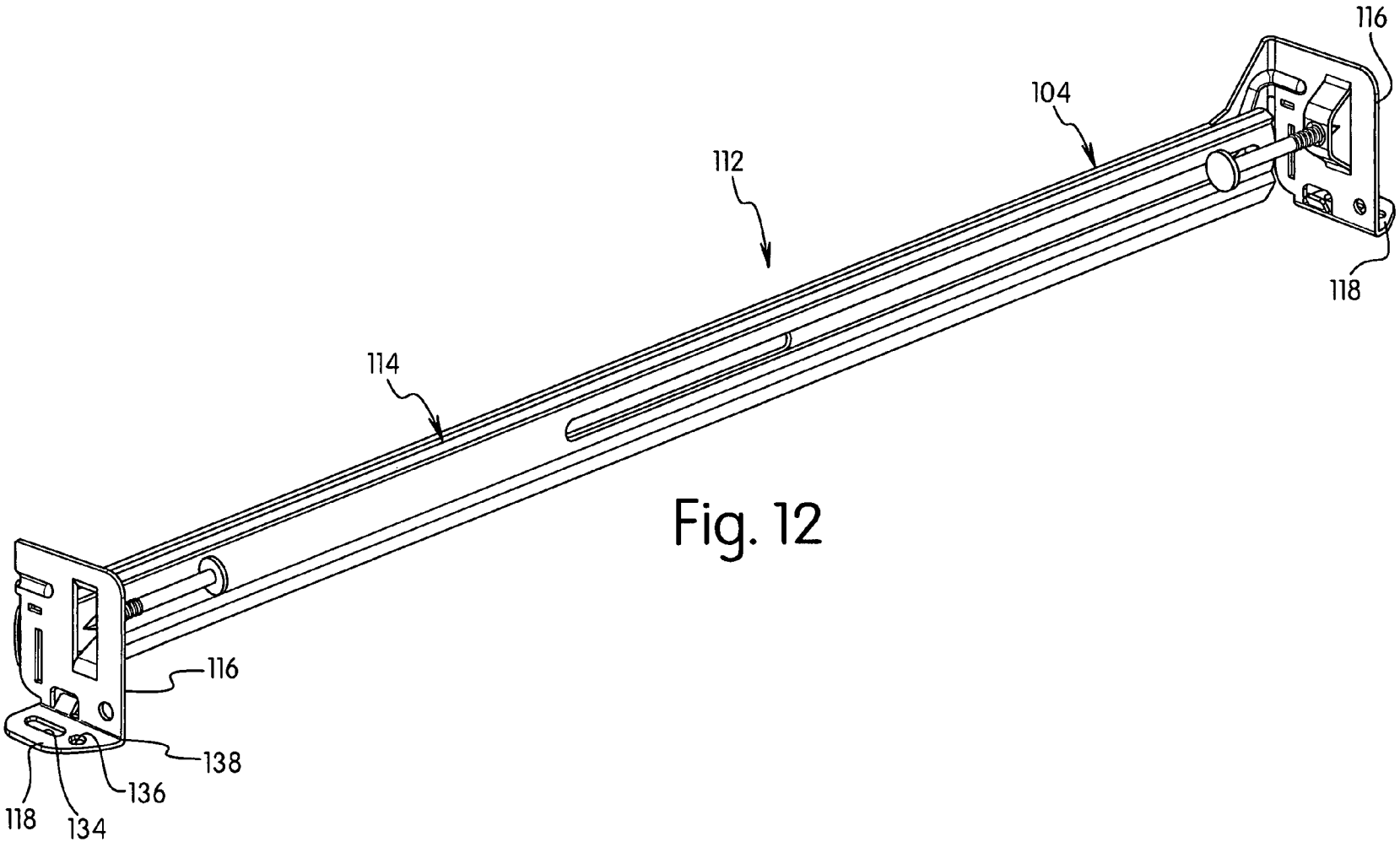
FIG. 12 is a perspective view of a bar hanger in a second embodiment of the invention.

Attachment member 118, as shown in FIG. 12, extends substantially perpendicular to the plane of mounting plate 116. Preferably, attachment member 118 includes an elongated hole 134 and a circular hole 136 for receiving fasteners to attach bar hanger 112 to a ceiling joist.

A third embodiment of the invention is shown in FIGS. 16-24. As in the previous embodiments, bar hanger 160 is adaptable for use in attaching to a ceiling joist or to a T-bar ceiling support. Bar hanger 160 includes support arms 162 having a longitudinal dimension with a first end 164 coupled to a mounting plate 166. Support arm 162 includes a notch 168 along a bottom edge 170 adjacent mounting plate 166 for receiving a T-bar.

Mounting plate 166 has a substantially planar configuration extending perpendicular to the plane of support arm 62 and includes a plurality of holes 172 for receiving fasteners to attach mounting plate 166 to a ceiling joist. A nailing bridge 174 for supporting a fastener is also provided as in the previous embodiments.

An attachment member 176 extends from a bottom edge 178 of mounting plate 166. Attachment member 176 has a substantially planar configuration and extends substantially perpendicular to the plane of mounting plate 166. Attachment member 176 is formed with an angled edge as shown to receive a tool to assist in removing attachment member 176 from a joist.

Figures 16, 17, 18:
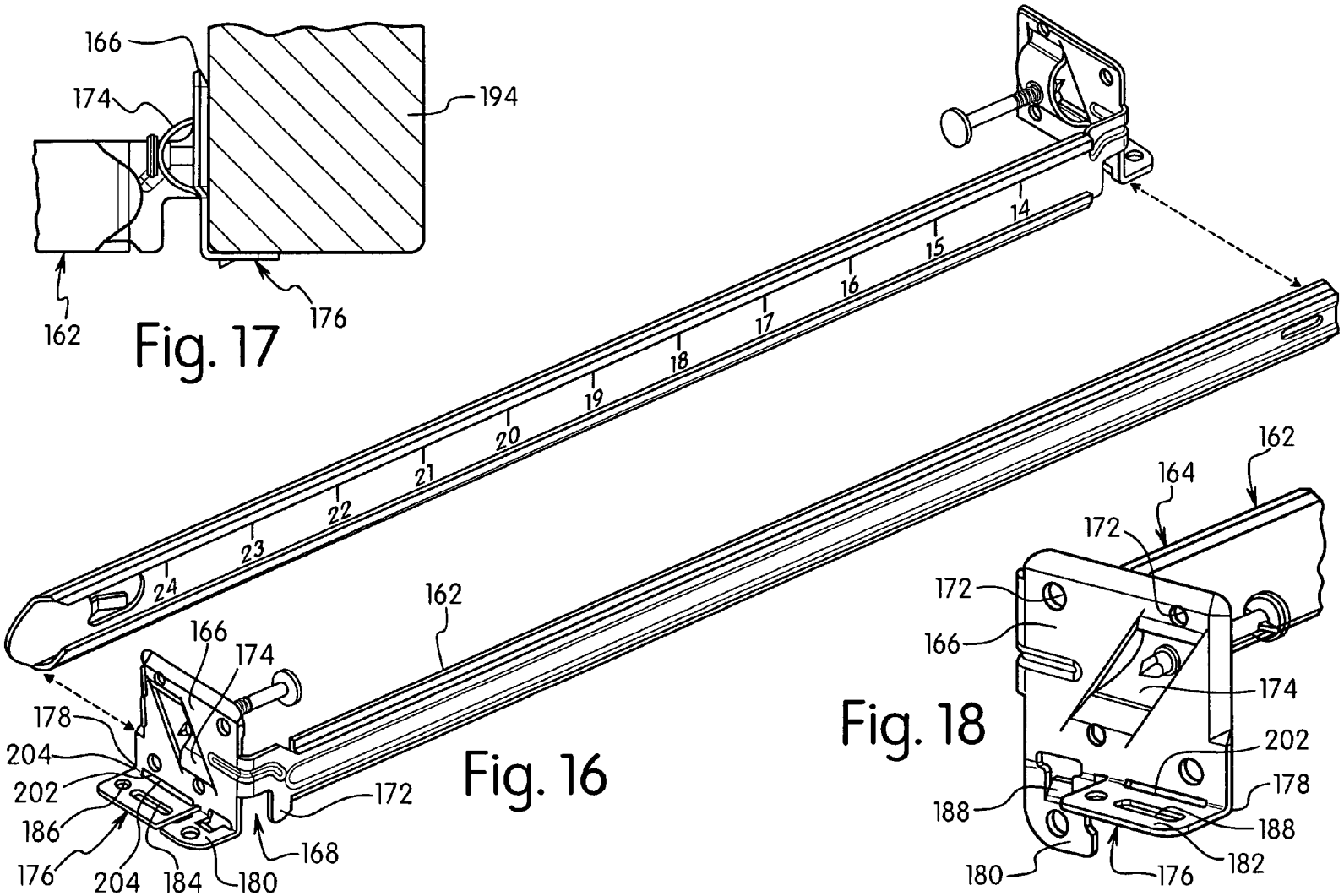
FIG. 16 is a perspective view of a bar hanger in a third embodiment of the invention.
FIG. 17 is a side elevational view showing the bar hanger of FIG. 16 mounted to a ceiling joist.
FIG. 18 is a perspective view showing a coupling tab bent to a position for engaging a T-bar hanger.

As shown in FIG. 16, attachment member 176 includes a first tab 180 and a second tab 182. Second tab 182 is provided with an elongated slot 184 and a circular hole 186 for receiving fasteners to attach attachment member 176 to the bottom surface of a ceiling joist. First tab 180 includes a barb or coupling tab 188 that is bent in a downward direction at an incline with respect to the plane of first tab 180. First tab 180 also includes a hole 190 for receiving a fastener.

Figure 19:
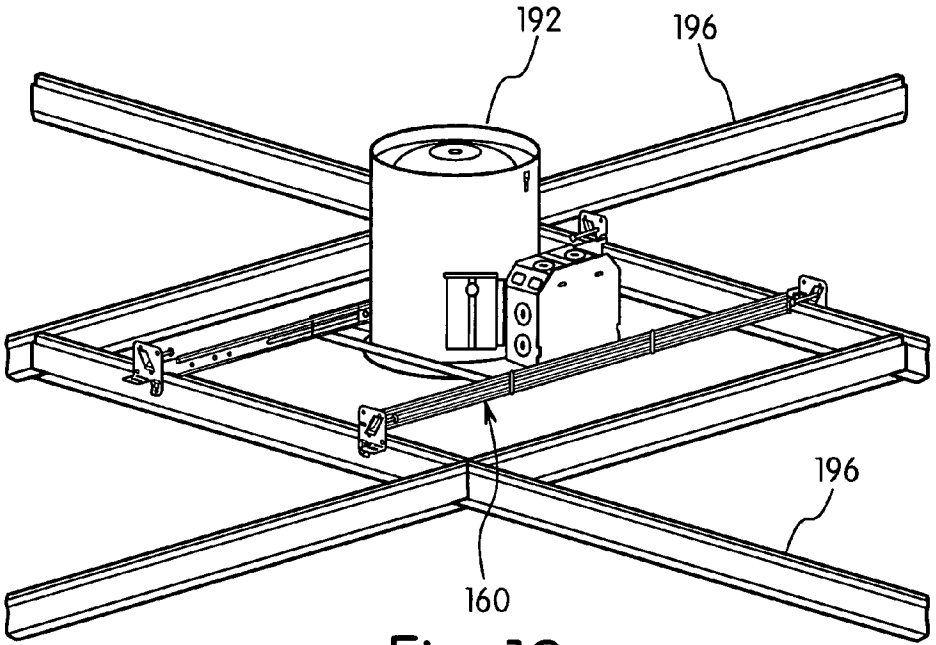
FIG. 19 is a perspective view showing the bar hanger assembly mounted on a T-bar support.

In use, bar hanger 160 is attached to a lighting fixture 192 shown in FIG. 19. As shown in FIG. 17, bar hanger 160 can be attached to a ceiling joist 194 by positioning attachment member 176 against a bottom edge and positioning mounting plate 166 against a side edge of joist 194. The fastener attached to nailing bridge 174 is then articulated to penetrate joist 194 to secure bar hanger 160 in position.

Figure 24:
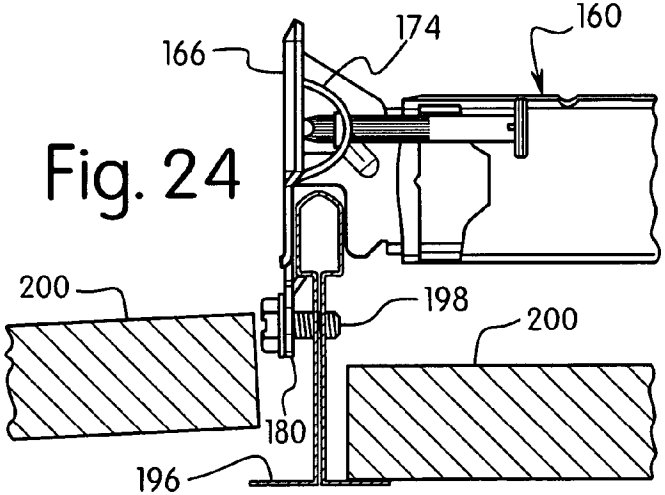
FIG. 24 is a side elevational view showing the bar hanger attached to a T-bar support.
Figure 21:
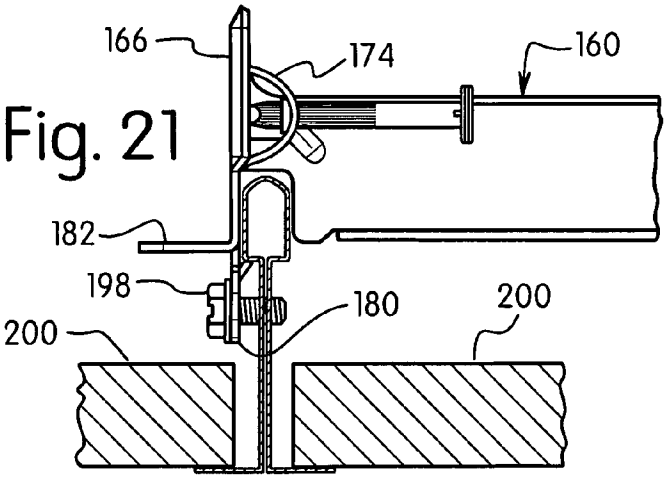
FIG. 21 is a side elevational view showing the bar hanger attached to a T-bar support.

The bar hanger 160 is also adaptable for use in a T-bar support in a manner similar to the previous embodiments. When the bar hanger 160 is used with a T-bar support, the first tab 180 is bent away from second tab 182 and mounting plate 166 to the position shown in FIG. 18 where second tab 182 is substantially parallel to and in the same plane as mounting plate 166. In this position, coupling tab 188 extends at an incline in a generally upward direction toward the top end of mounting plate 166 and toward notch 168. Bar hanger 160 fits onto the T-bar support 196 so that the top end of T-bar 196 is received in notch 168 as shown in FIG. 19. Coupling tab 188 is positioned below the lip of the top end of T-bar 196 as shown in FIG. 21 to limit vertical movement of bar hanger 160 with respect to T-bar 196. With tab 188 in a primarily parallel orientation relative to mounting plate 166, hole 190 is positioned to allow a secondary fastener such as a screw to driven below the top of a T-bar support. Referring to FIG. 24, ceiling tile 200 can be lifted upwardly and removed without interference from second tab 182.

Figure 20:
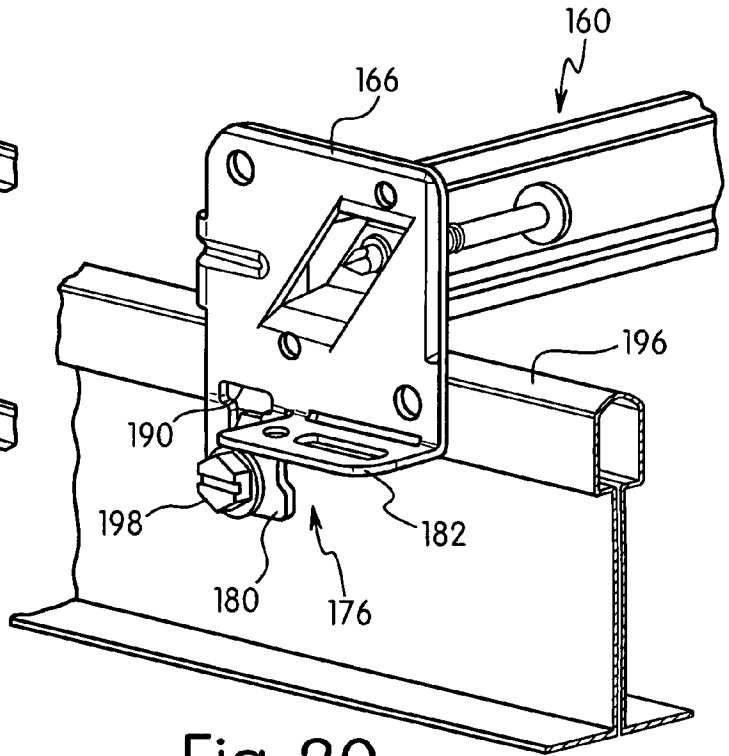
FIG. 20 is a perspective end view showing the bar hanger attached to a T-bar support.
Figure 22:
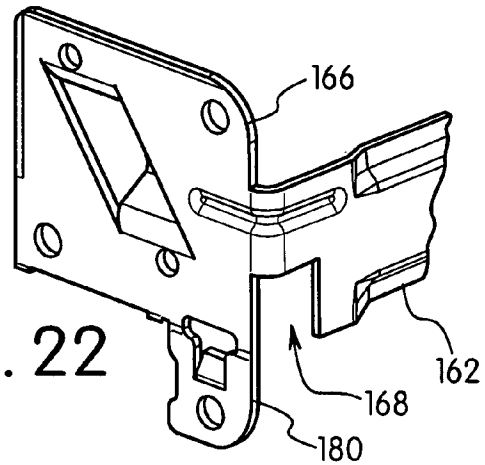
FIG. 22 is a perspective view showing the end of the bar hanger with the attachment tab removed.
Figure 23:
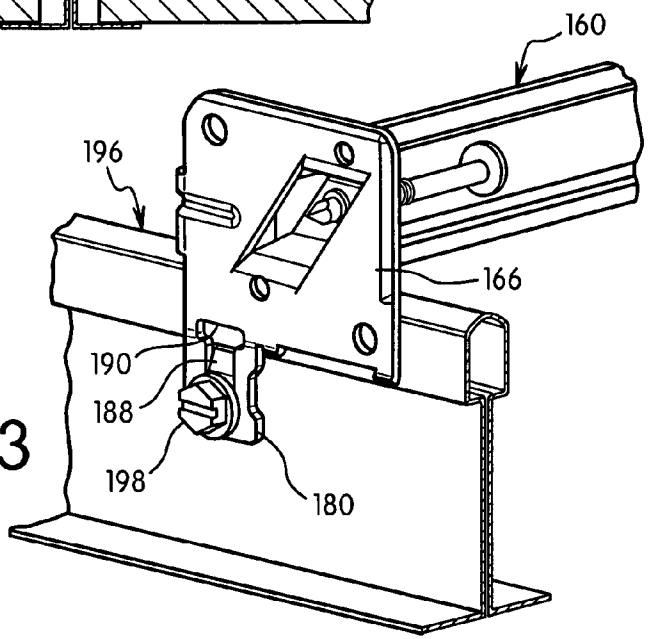
FIG. 23 is a perspective view showing the bar hanger attached to a T-bar support.

Referring to FIG. 20, second tab 182 is retained in its original position and extends perpendicular to the plane of mounting plate 166. In a manner similar to the embodiment shown in FIG. 11, second tab 182 can be coupled to an adjoining tab of a bar hanger by a suitable fastener. First tab 180 is secured to T-bar 196 by the fastener 198. In one embodiment, second tab 182 can interfere with the removal of ceiling tiles 200 as shown in FIG. 21 when the ceiling tiles are lifted in an upward direction for removal or assembly. Second tab 182 can be removed by breaking along the fold lines connecting second tab 182 to mounting plate 166. A slot 202 is provided along the connection between second tab 182 and mounting plate 166 so that second tab 182 is coupled to mounting plate 166 by a pair of legs 204. Second tab 182 can be bent to break connecting legs 204 so that second tab 182 can be removed as shown in FIG. 22. Bar hanger 160 is then coupled to the ceiling joist as shown in FIGS. 23 and 24.

While various embodiments have been chosen to illustrate the invention, it will be appreciated that various changes and modifications can be made without departing from the scope of the invention as defined in the appended claims.

What is claimed is:

1. A bar hanger for supporting a recessed electrical device on a ceiling support, said bar hanger having first and second telescoping support arms slidably connected together, each support arm comprising:

an elongated support body having a first end and a second end, a mounting plate having a top edge, a bottom edge, an outer side edge and an inner side edge, said inner side edge being coupled to said first end of said body and extending substantially perpendicular to a plane of said support body, said mounting plate having at least one aperture for receiving a fastener; and an attachment member coupled to said bottom edge of said mounting plate along a fold line, said attachment member having a substantially planar first side facing in an upward direction with respect to said top edge of said mounting plate and an opposite second side facing in a downward direction, and a detent extending from said second side out of a plane of said attachment member, said attachment member being bendable from a first position where said attachment member extends substantially perpendicular to said mounting plate for contacting a bottom surface of a ceiling joist to a second position substantially parallel to said mounting plate where said detent is adapted for contacting a bottom portion of a T-bar support.

2. The bar hanger of claim 1, wherein said attachment member has a first side edge coupled to said bottom edge of the mounting plate, a second outer edge opposite said first side edge, a third side edge and a fourth side edge opposite said third side edge.

3. The bar hanger of claim 2, wherein said detent is a tab provided at said first side edge and extending at an incline with respect to a plane of said attachment member.

4. The bar hanger of claim 2, wherein said detent is a coupling tab extending from one of said side edges and oriented at an incline with respect to a plane of said attachment member.

5. The bar hanger of claim 2, further comprising a first coupling tab coupled to said third edge of said attachment member and a second coupling tab extending from said fourth side edge, said first and second tabs defining said detent.

6. The bar hanger of claim 1, wherein each of said support arms have a notch in a bottom side for receiving the T-bar support and wherein said detent engages a lip of said T-bar when said attachment member is in said second position to couple said bar hanger to said T-bar support.

7. The bar hanger of claim 1, wherein said support body has a notch in a bottom side edge adjacent said mounting plate for receiving the T-bar support.

8. The bar hanger of claim 1, wherein said mounting plate has a removable portion to form an opening to allow a body portion of a cooperating support arm to extend beyond mounting plate.

9. The bar hanger of claim 1, wherein said attachment member comprises a first tab and a second tab, and where said detent is integrally formed with said first tab, and said first and second tabs are oriented substantially perpendicular to a plane of said mounting plate.

10. The bar hanger of claim 9, wherein said first tab has a third tab cut from said first tab and bent out of the plane of said first tab, said third tab defining said detent.

11. A bar hanger for supporting a recessed electrical device to a ceiling support, said bar hanger having first and second telescoping support arms coupled together for sliding movement in a longitudinal direction, each said support arm comprising:

a support body having a longitudinal dimension with a first end, a second end, a top edge and a bottom edge, said bottom edge having a recess at said first end with a dimension to receive a T-bar support;

a mounting plate having a side edge, a top edge and a bottom edge, said side edge being coupled to said first end of said support body and extending substantially perpendicular to a plane of said support body, said mounting plate having at least one aperture for receiving a fastener for attaching said mounting plate to a ceiling joist; and a first attachment member and a second attachment member coupled to said bottom edge of said mounting plate and extending in a direction substantially perpendicular to said mounting plate for attaching to a bottom side of a ceiling joist, said first attachment member having a detent extending from a bottom side out of the plane of said first attachment member, and where said first attachment member is bendable from a first position perpendicular to said mounting plate to a second position substantially parallel to said mounting plate for contacting said detent with a bottom surface of the T-bar support for coupling the bar hanger to said T-bar support.

12. The bar hanger of claim 11, wherein said first attachment member has a planar center portion with a first end and a first coupling tab extending from said first end at an incline with respect to a plane of said center portion.

13. The bar hanger of claim 12, wherein said planar center portion has a pair of coupling tabs.

14. The bar hanger of claim 12, wherein said first and second attachment member are substantially perpendicular to said mounting plate.

15. The bar hanger of claim 14, wherein said second attachment member has a main body and a pair of legs extending substantially perpendicular to said mounting plate.

16. The bar hanger of claim 11, wherein said first attachment member includes a coupling tab cut from said first attachment member on an edge joining said mounting plate and extending at an incline with respect to a plane of said first attachment member, said tab defining said detent.

17. The bar hanger of claim 11, wherein said first attachment member has a first edge coupled to said mounting plate, said first edge including a tab extending at an incline with respect to a plane of said first attachment, said tab defining said detent.

18. The bar hanger of claim 11, wherein said mounting plate has a removable portion defined by frangible lines, said removable portion being positioned to form an opening when removed to enable a body portion of a cooperating support arm to pass through.

19. A bar hanger for supporting a recessed electrical device, said bar hanger having first and second telescoping support arms coupled together for sliding movement in a longitudinal direction, each said support arm comprising:

a support body having a longitudinal dimension with a first end and a second end, a top edge and bottom edge;

a mounting plate having a side edge coupled to said first end of said support body and extending in a direction substantially perpendicular to the longitudinal dimension of the support body, an attachment member extending from a bottom edge of said mounting plate for contacting a bottom edge of a ceiling joist, said mounting plate having an aperture for receiving a fastener and a cut portion defining an opening in said mounting plate and a raised bridge integrally formed with said mounting plate and having a center portion spaced from said mounting plate to define an opening between said center portion and said mounting plate, a fastener extending through and coupled to said bridge, said bridge having a longitudinal dimension extending at an acute angle with respect to a plane of said attachment member and at an incline with respect to said bottom edge of said mounting plate to enable a tool to be inserted into said opening from a direction below the ceiling joist and in a direction parallel to the ceiling joist and apply leverage against the ceiling joist.

20. The bar hanger of claim 19, wherein said attachment member has a detent extending out of the plane of said attachment member, said attachment member being oriented substantially perpendicular to a plane of said mounting plate, and being bendable to a position substantially parallel to said mounting plate where said detent is able to contact a bottom edge of a T-bar support.

21. The bar hanger of claim 20, wherein said attachment member has a first inner side edge coupled to said mounting plate, a second outer side edge, a third side edge and a fourth side edge and where said detent is a tab extending from one of said side edges.

22. The bar hanger of claim 21, wherein said detent is a tab provided at said first side edge and extending at an incline with respect to said attachment.

23. The bar hanger of claim 21, wherein said tab extends from said first side edge.

24. The bar hanger of claim 20, wherein said attachment member has a first side edge coupled to said mounting plate, and a second opposite side edge, and where said detent is a first tab coupled to a third side edge of said attachment member and a second tab extending from a fourth side edge of said attachment member, said first and second tabs extending out of a plane and at an incline with respect to said attachment member.

25. The bar hanger of claim 19, wherein said support body has a notch in a bottom edge adjacent said mounting plate for receiving a T-bar support and where said attachment member is bendable to a position parallel to said mounting plate to engage the T-bar support and couple the bar hanger to the T-bar support.

26. The bar hanger of claim 19, wherein said mounting plate has a removable portion to form an opening to allow a body portion of a cooperating support arm to extend beyond the mounting plate.

27. The bar hanger of claim 19, wherein said attachment member comprises a first attachment plate and a second attachment plate, and where said second attachment plate includes a tab extending at an incline with respect to a plane of said second attachment plate.

28. The bar hanger of claim 1, wherein said bottom edge of said mounting plate is substantially perpendicular to said inner side edge.

29. The bar hanger of claim 1, wherein said detent is a coupling tab adapted for coupling with the T-bar support and said coupling tab extending from an edge of said attachment member.

30. The bar hanger of claim 11, wherein said bottom edge of said mounting plate is substantially perpendicular to said side edge.

* * * * *